US009961972B1

(12) United States Patent
Bonner

(10) Patent No.: US 9,961,972 B1
(45) Date of Patent: May 8, 2018

(54) JEWELRY PRODUCT

(71) Applicant: Robert Jason Bonner, Miramar, FL (US)

(72) Inventor: Robert Jason Bonner, Miramar, FL (US)

(73) Assignee: National Chain Company, Warwick, RI (US)

( * ) Notice: Subject to any disclaimer, the term of this patent is extended or adjusted under 35 U.S.C. 154(b) by 7 days.

(21) Appl. No.: 15/287,895

(22) Filed: Oct. 7, 2016

Related U.S. Application Data

(60) Provisional application No. 62/243,283, filed on Oct. 19, 2015, provisional application No. 62/243,278, filed on Oct. 19, 2015.

(51) Int. Cl.
*A44C 25/00* (2006.01)
*A44C 15/00* (2006.01)
*A44C 5/00* (2006.01)

(52) U.S. Cl.
CPC ..... *A44C 25/007* (2013.01); *A44C 5/0007* (2013.01); *A44C 15/005* (2013.01); *A44C 25/001* (2013.01)

(58) Field of Classification Search
CPC ..... A44C 25/007; A44C 25/00; A44C 25/001; A44C 15/005; A44C 5/0007
USPC ..... 63/1.11, 1.12, 1.18; D11/44
See application file for complete search history.

(56) References Cited

PUBLICATIONS

Beckie Farrant, Nuts and Colored Bolts Necklace, Nov. 3, 2013, infarrantlycreative.net, pp. 1-7.*
Momotique, Stainless Steel Nut and Bolt Pendant, Jun. 8, 2011, etsy.com, pp. 1-7.*

* cited by examiner

*Primary Examiner* — Abigail E Troy
(74) *Attorney, Agent, or Firm* — Salter & Michaelson

(57) ABSTRACT

A jewelry product that is to be worn by a user and that is formed as a threaded main shaft, along with a hanging link for support of the threaded main shaft from a body part. One or more decorative nuts are for threaded engagement with the threaded main shaft, and a securing member is for attaching the hanging link with the threaded main shaft. In another embodiment there is a partially closed loop that is comprised of separate loop portions, a pivot pin that connects the separate loop portions and that enables the separate loop portions to open and close, a sleeve disposed about the partially close loop and slideable to cover and uncover the pivot pin and a threaded main shaft engaged with the threaded opening of the respective heads.

18 Claims, 15 Drawing Sheets

JEWELRY PRODUCT

RELATED APPLICATIONS

Priority for this application is hereby claimed under 35 U.S.C. § 119(e) to commonly owned and U.S. Provisional Patent Application Nos. 62/243,283 and 62/243,278 which were both filed on Oct. 19, 2015 and each of which is incorporated by reference herein in its entirety.

FIELD OF THE INVENTION

The present invention relates in general to a novel jewelry product. More particularly, there is described herein a product in which components of the product can be readily interchangeable so as to provide a variety of different jewelry product configurations.

BACKGROUND OF THE INVENTION

At the present time, although there are a variety of different jewelry products that are available, the existing products are very limited in their use and furthermore do not provide for any substantial interchange of jewelry product components.

Accordingly, it is an object of the present invention to provide a novel jewelry product having an improved construction.

Another object of the present invention is to provide a novel jewelry product in which components of the product can be readily interchangeable so as to provide a variety of different jewelry product configurations.

Still another object of the present invention is to provide a novel jewelry product in which additional jewelry components can be readily engaged or disengaged, as well as moved to different locations to provide multiple jewelry product configurations.

SUMMARY OF THE INVENTION

To accomplish the foregoing and other objects and advantages of the present invention there is provided a jewelry product that is to be worn by a user and that is comprised of a threaded main shaft, a hanging link for support of the threaded main shaft from a body part, one or more decorative nuts for threaded engagement with the threaded main shaft, and a securing member for attaching the hanging link with the threaded main shaft.

In accordance with other aspects of the present invention the threaded main shaft includes at least a threaded shaft portion and a head portion that is disposed at one end of the threaded shaft portion, and the head portion has a through hole, said securing member comprising the through hole, said hanging link passing through the hole in the head portion; more than one nut is used and adjacent nuts are maintained in contact with each other and the head portion is hexagonal in shape; the threaded shaft portion has a length an order of magnitude longer than a length of the head portion; adjacent nuts are each hexagonal in shape and are of different diameter; the securing member comprises a through hole that extends through the threaded main shaft, said hanging link passing through the through hole in the threaded main shaft; and the threaded main shaft is of a solid material and the securing member comprises a pair of securing hooks, one at each end of the threaded main shaft.

In accordance with another embodiment of the present invention there is provided a jewelry product that is to be worn by a user and comprised of a partially closed loop that is comprised of separate loop portions, a pivot pin that connects the separate loop portions and that enables the separate loop portions to open and close, a sleeve disposed about the partially close loop and slideable to cover and uncover the pivot pin, with each of the loop portions having an end head with an internally threaded opening, and a threaded main shaft engaged with the threaded opening of the respective heads.

In accordance with other aspects of the present invention the threaded main shaft is comprised of separate one and other threaded shaft portions; including one or more decorative nuts engaged with the threaded main shaft; including at least one decorative nut threaded with respective one and other threaded shaft portions; wherein each head has a hexagonal shape; wherein the separate one and other threaded shaft portions have a gap defined therebetween; wherein the sleeve is long enough to cover the pivot pin in a closed position and is slideable over one of the loop portions to enable the loop to open; wherein, in the open position of the loop, the gap is larger thus enabling decorative nuts to be threaded onto either of the respective heads; and wherein the loop is in the form of a bracelet.

In accordance with still another embodiment of the present invention there is provided a jewelry product that is to be worn by a user and comprised of a partially closed loop that is comprised of separate loop portions that are fixed relative to each other, each of the loop portions having an end head with an internally threaded opening, and a threaded main shaft engaged with the threaded opening of the respective heads.

In accordance with further aspects of the present invention each head is hexagonal in shape; the respective head openings are in linear alignment. and including one or more decorative nuts disposed between the respective heads and engaged with the threaded main shaft.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

Figure 5:
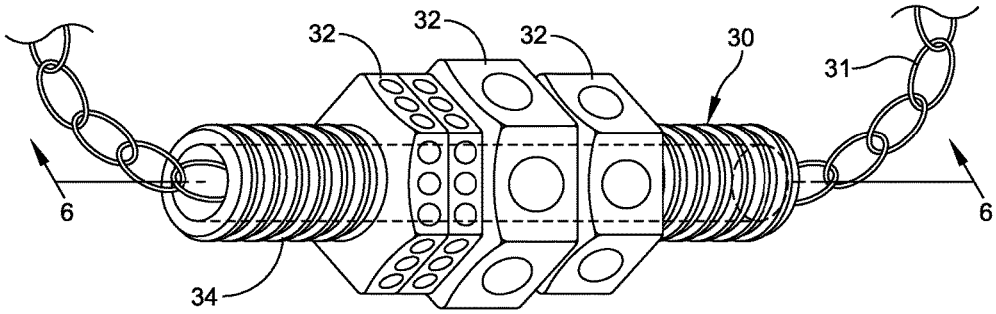
FIG. 5 is a perspective view of a second embodiment of the present invention.
Figure 6:
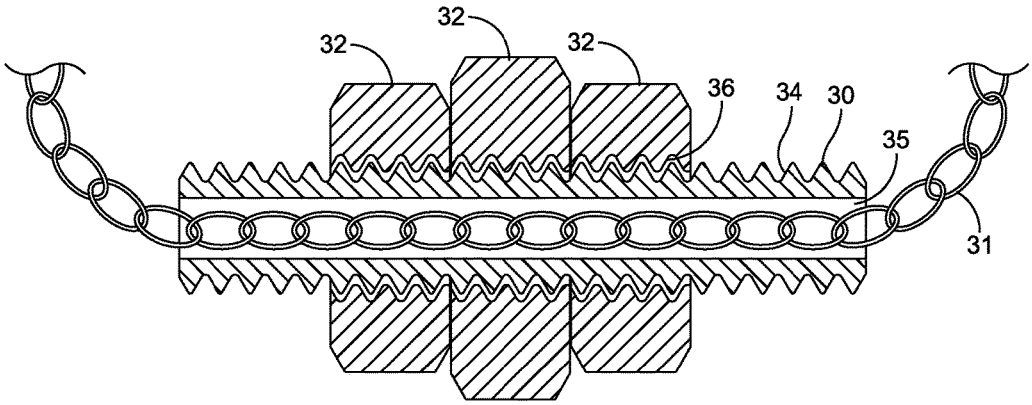
FIG. 6 is a cross-sectional view taken along line 6-6 of FIG. 5.
Figure 7:
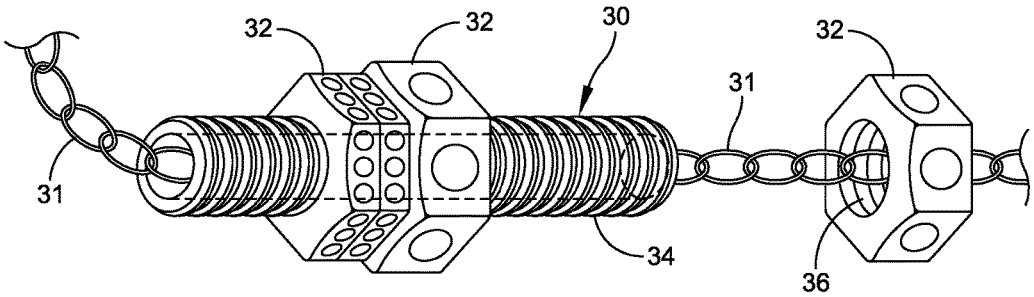
FIG. 7 is a perspective view similar to that shown in FIG. 5 but with one of the decorative nuts being unthreaded.
Figure 8:
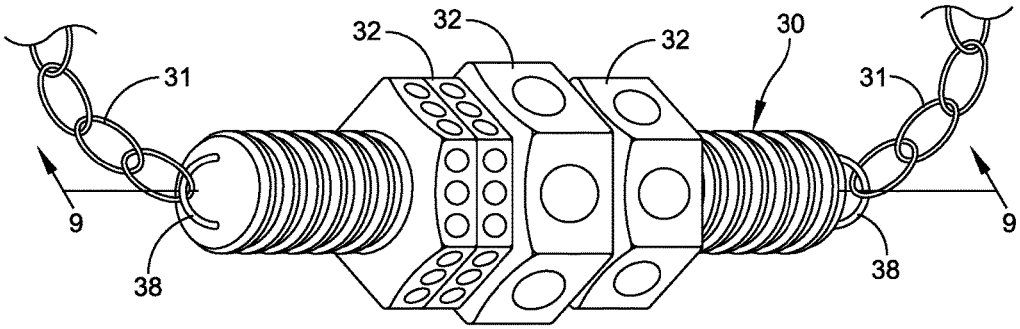
FIG. 8 is a perspective view of a third embodiment of the present invention.
Figure 9:
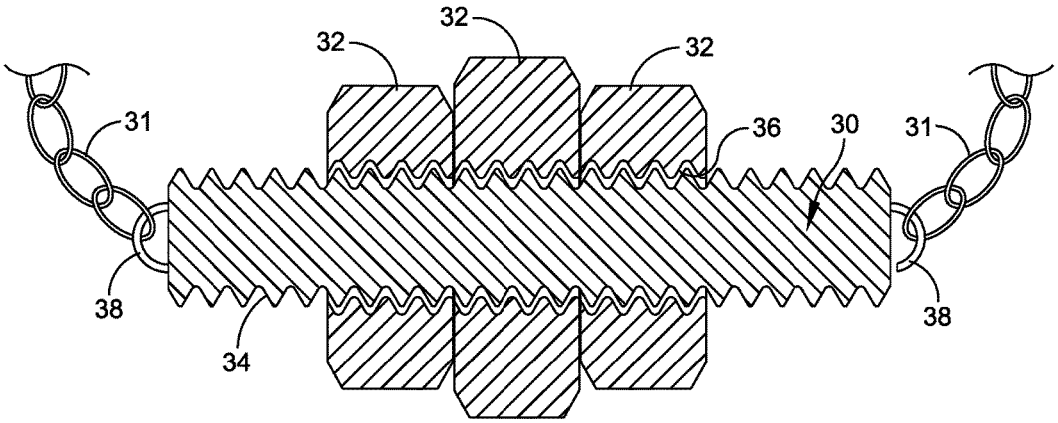
FIG. 9 is a cross-sectional view taken along line 9-9 of FIG. 8.
Figure 10:
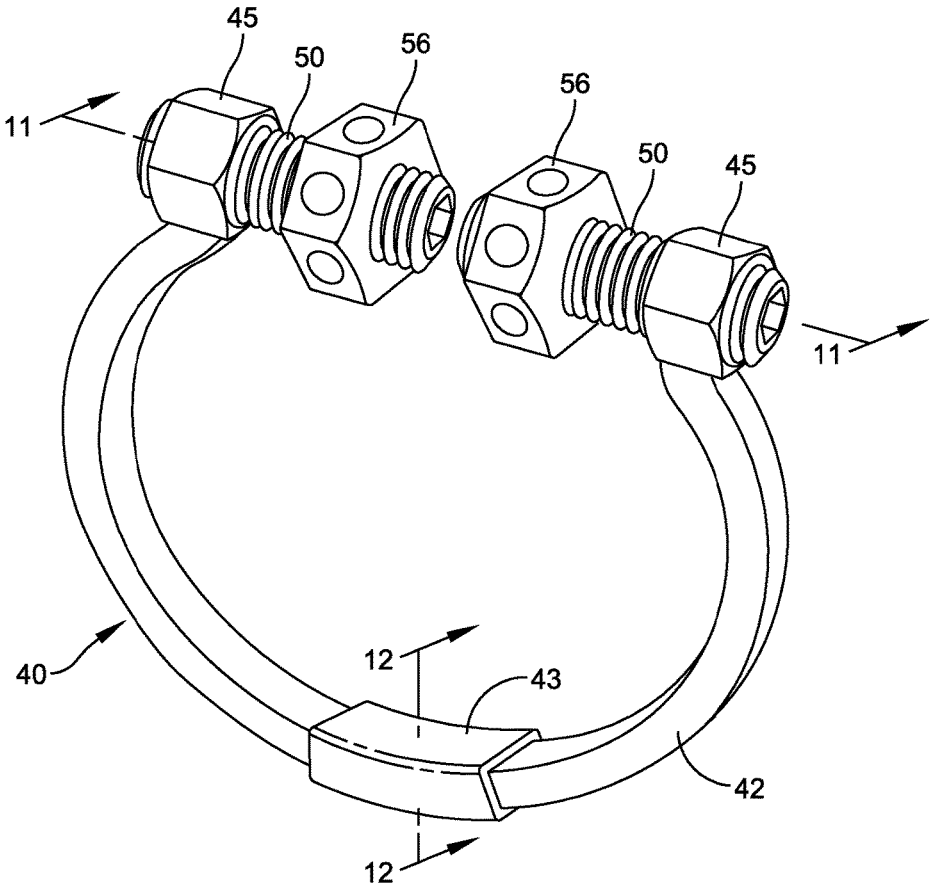
FIG. 10 is a fourth embodiment of the present invention shown in a perspective view.
Figure 11:
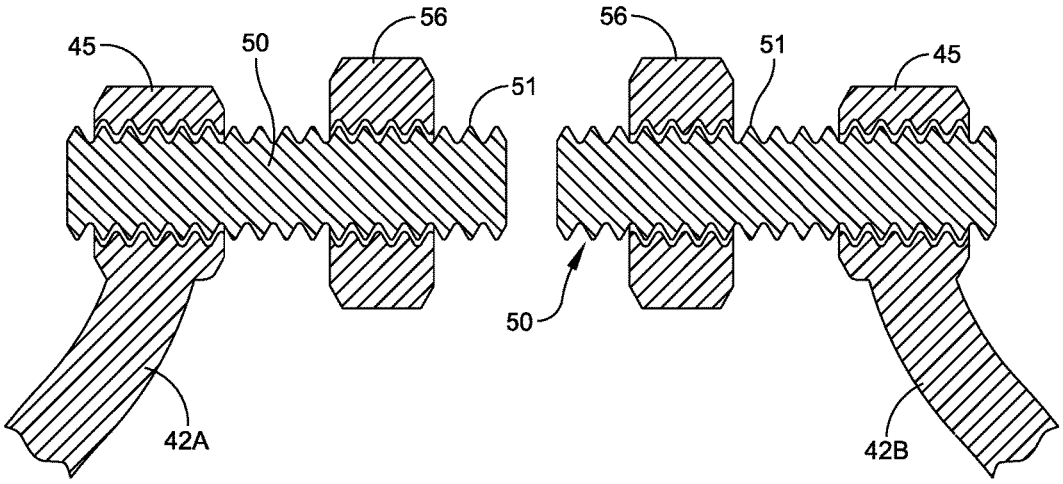
FIG. 11 is a cross-sectional view taken along line 11-11 of FIG. 10.
Figure 12:
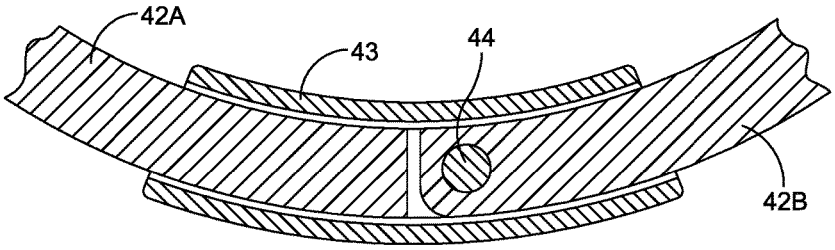
FIG. 12 is a cross-sectional view taken along line 12-12 of FIG. 10.

FIGS. 1-4 illustrate a first embodiment of the present invention in the form of a jewelry product for a necklace or bracelet. FIGS. 5-7 illustrate another embodiment of the jewelry product for use with a necklace or bracelet. FIGS. 8 and 9 illustrate still a further embodiment of the jewelry product for use with a necklace or bracelet. FIGS. 10-15 illustrate an embodiment of the present invention in the form of a bracelet. FIGS. 16-20 illustrate still another embodiment for the bracelet. The jewelry product is illustrated in association with a necklace or bracelet link shown at 15 and also referred to herein as a hanging link. The basic jewelry piece 10 is comprised of a main threaded shaft 12 that includes a threaded shaft portion 14 and a head portion 13. The threaded shaft 14 is shown as having external threads 16 such as depicted in the cross-sectional view of FIG. 2. The head 13 of the main shaft 12 has a through passage 17 for receiving links 15 such as depicted in the cross-sectional view of FIG. 2.

Also illustrated as part of this jewelry piece 10 are a series of decorative nuts 20. These nuts 20 are shown threaded onto the threads 16 of the threaded shaft 14. Each of the nuts may have an internal thread 21 such as shown in the exploded perspective view of FIG. 3.

Figure 1:
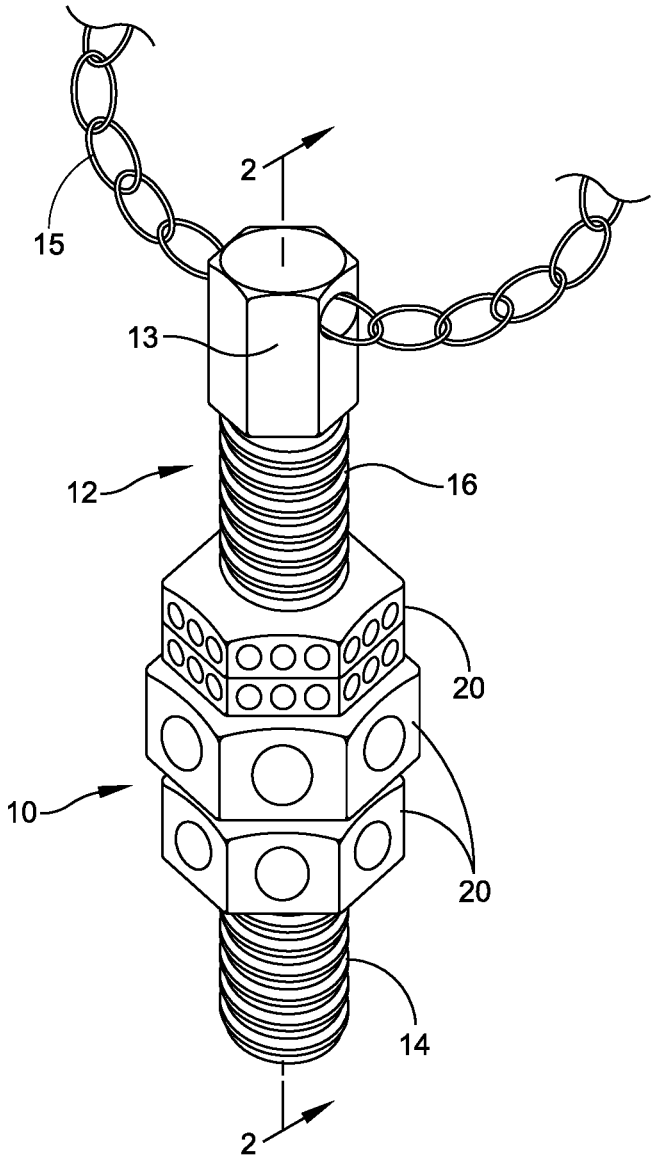
FIG. 1 is a perspective view of a first embodiment of the present invention.
Figure 2:
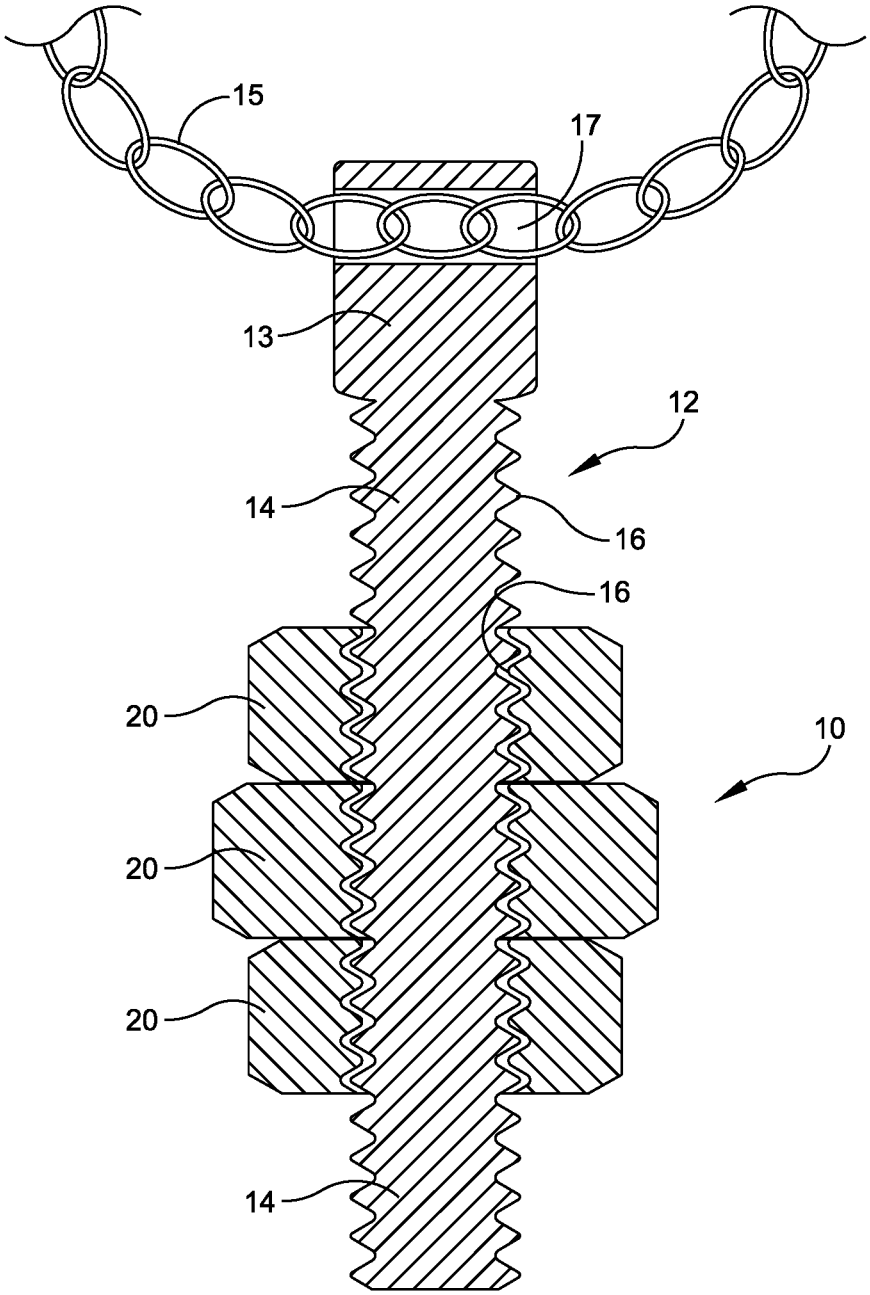
FIG. 2 is cross-sectional view taken along line 2-2 of FIG. 1.
Figure 3:
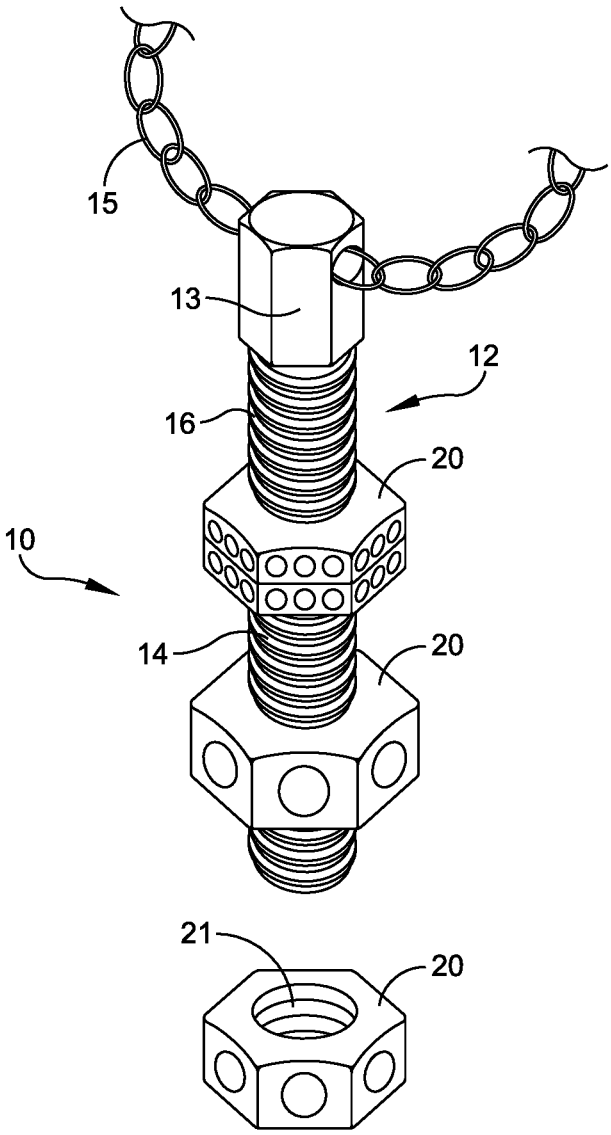
FIG. 3 is a perspective view similar to that shown in FIG. 1 with one of the decorative nuts threaded off of the main shaft.
Figure 4:
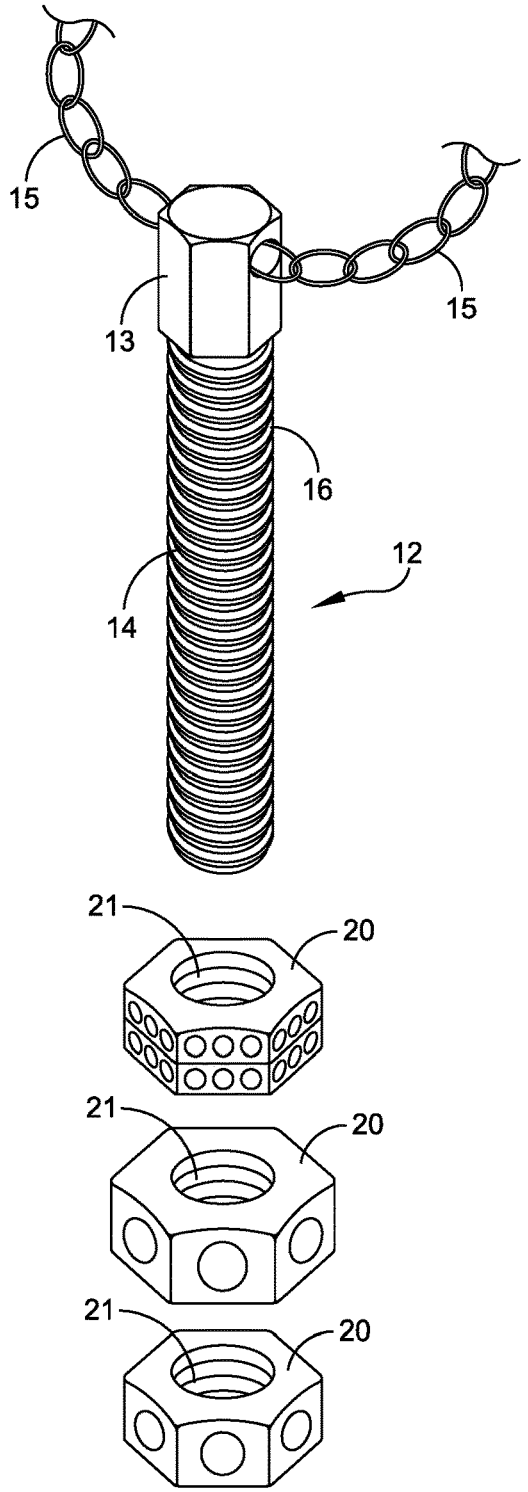
FIG. 4 is an exploded perspective view for the first embodiment.

In the first embodiment illustrated in FIGS. 1-4, it is noted that the main shaft may be used with other embodiments described herein including those in FIGS. 10-20. Also, the nuts 20 shown in FIGS. 1-4 may also be incorporated into other embodiments such as the one shown in FIGS. 5-7 or even the embodiments illustrated in FIGS. 10-20. FIG. 2 in particular shows one nut arrangement in which adjacent nuts are held in contact with each other. In another arrangement the nuts may be separated from each other or there may be a combination of contacts and separation.

Another embodiment of the present invention is illustrated in FIGS. 5-7 which includes necklace or bracelet links 31 and a threaded shaft 30. In this instance, rather than having a head on the threaded shaft, the threaded shaft is provided with a central through passage 35 for receiving the links 31 such as illustrated in the cross-sectional view of FIG. 6. The passage 35 extends through the entire length of the threaded shaft 30. The threaded shaft 30 has external threads 34. Each of the nuts 32 has internal threads such as shown at 36 in FIG. 7. This arrangement enables a certain amount of sliding of the jewelry product along the links 31. Also, in this embodiment the nuts are shown in contact with an adjacent nut but many different arrangements may be provided wherein some nuts are in contact and others spaced apart.

Another embodiment of the present invention is illustrated in FIGS. 8 and 9. In FIGS. 8 and 9 the same reference numbers are used to identify like components as described in the embodiments shown in FIGS. 5-7. However, in this embodiment the threaded shaft 30 is solid (see the cross-sectional view of FIG. 9) without any passage but instead has end hooks 38 to which separate sections of the links 31 can be connected. In the embodiment of FIGS. 7-9, the nuts can be readily threaded on to and off of the main threaded shaft 30.

Figure 13:
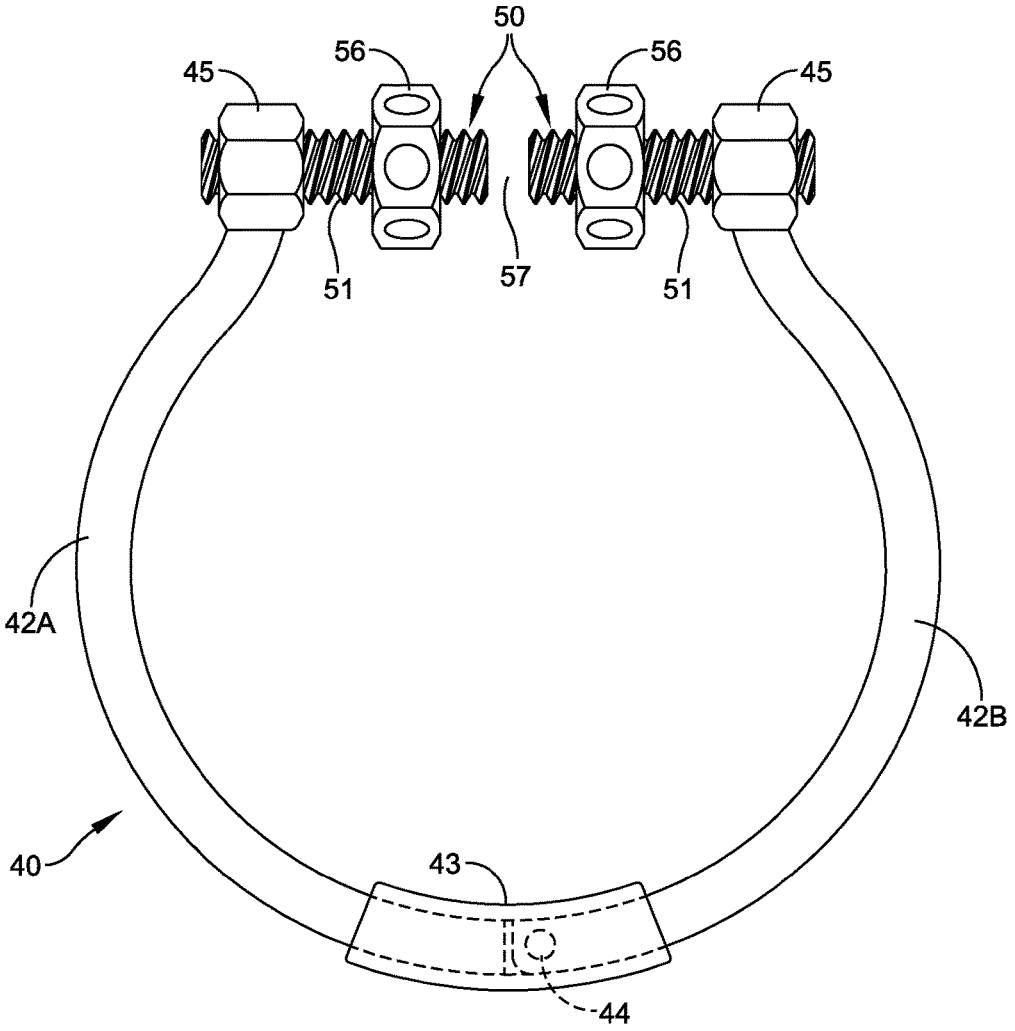
FIG. 13 is a front elevation view of the embodiment illustrated in FIG. 10.
Figure 14:
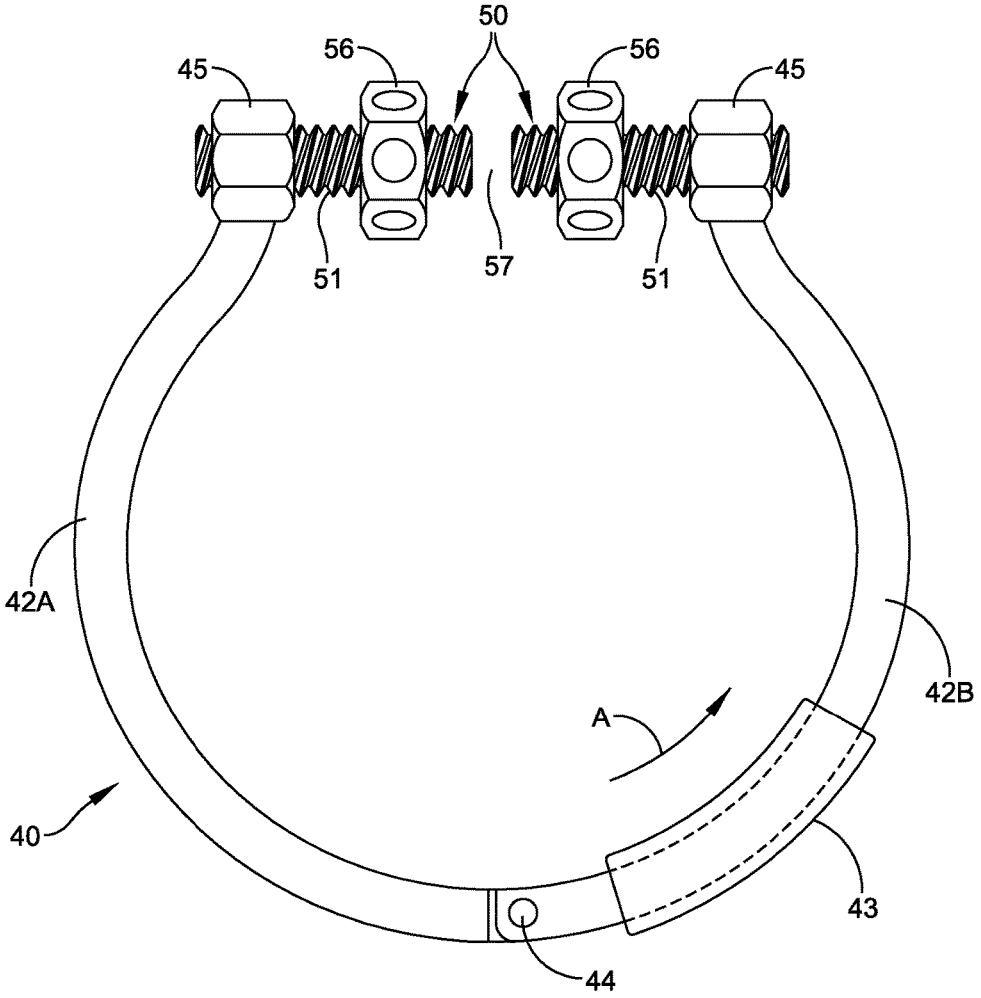
FIG. 14 is a front elevation embodiment of the embodiment shown in FIG. 10 with the sleeve slid to expose the pivot end.
Figure 15:
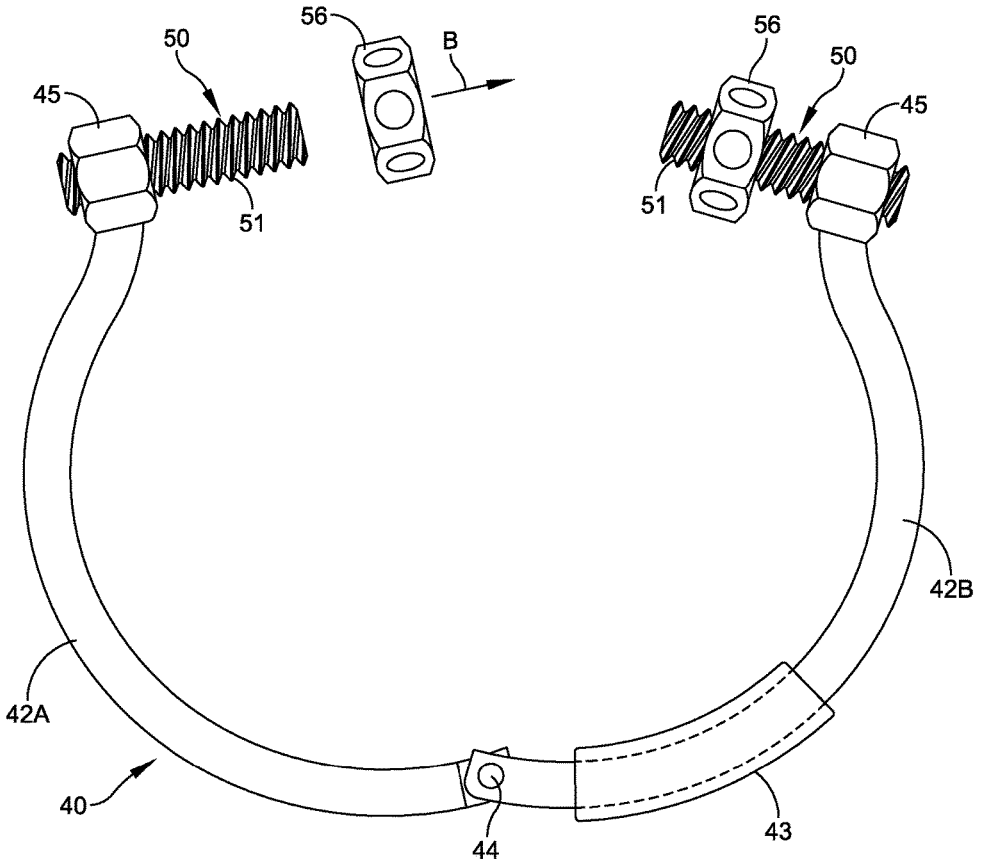
FIG. 15 is a front elevation view illustrating the portions of the loop pivoted so as to provide ready access to the threaded shafts.
Figure 16:
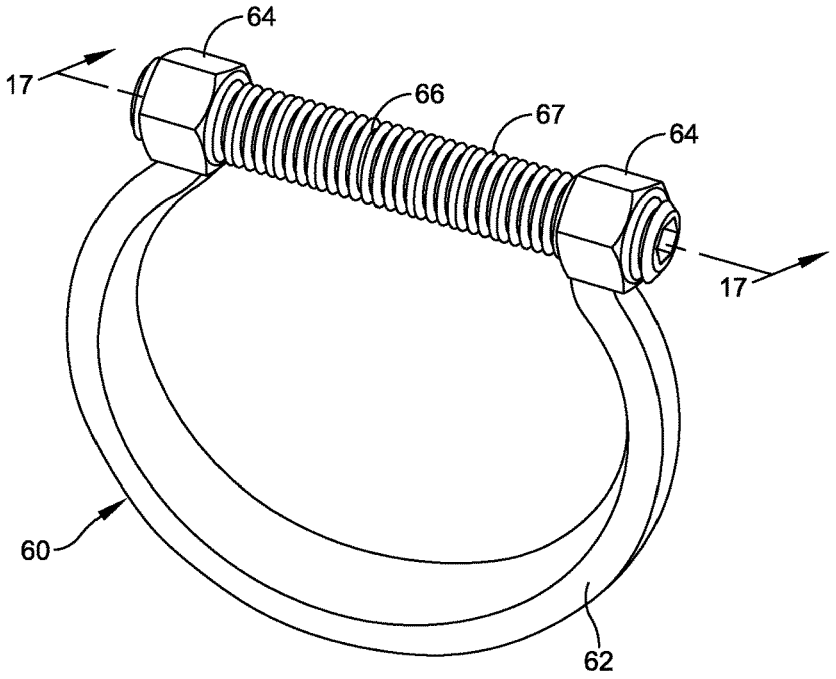
FIG. 16 is a perspective view of a fifth embodiment of the present invention.

Reference is now made to FIGS. 10-15 for another embodiment in accordance with the present invention which is primarily in the form of a bracelet 40. The bracelet 40 has a main loop 42 with separate sections 42A, 42B thereof connected at a pivot 44. The separate loop portions or sections are illustrated, for example, in FIG. 13 by way of illustration. A slideable sleeve 43 is shown extending about this main loop section and over the pivot location. In this regard FIG. 13 shows the sleeve 43 in place preventing any pivoting between the sections 42 of the main loop. On the other hand, FIG. 14 illustrates the sleeve 43 being slid in the direction of arrow A so as to expose the pivot 44 and enabling a pivoting action such as illustrated in FIG. 15. The sleeve 43 may be formed of many different materials including, but not limited to, a plastic or rubber material. Pin 44 may be a metal pin allowing oration of the loop portions 42A, 42B.

Each end of the main loop 42 terminates in a head 45 which may be hexagonal or octagonal. Each of these heads has an internal threaded passage for receiving respective and separate threaded shafts 50. Refer in particular to the cross-sectional view of FIG. 11 and the side elevation view of FIG. 13. These shafts 50 have external threads for mating with internal threads of the respective nuts 56. The nuts 56 are preferably decorative pieces and are readily threaded onto the respective threaded shafts 50. In positions such as illustrated in FIGS. 13 and 14, there is preferably a gap at 57 between facing ends of the threaded shafts 51. Also, as illustrated in FIG. 15, when the main loop portions 42 are pivoted apart, the gap is widened and thus one or more nuts 56 can be threaded onto each of the threaded shafts 51. FIG. 15, by way of illustration, shows one of the nuts 56 being threaded off of the left hand shaft 50 in the direction of arrow B, while on the right the nut 56 is threaded about the right most threaded shaft 51. Once the desired decorative pieces are threaded back onto their respective shafts, then the loop portions 42*a*, 42B may be closed to a position shown in FIG. 14 and the sleeve 43 then again slid over the pivot 44 to the position such as illustrated in FIG. 13. The sleeve 43 is preferably of sufficient length to cover the pivot a distance on either side of the pivot as shown in FIG. 13. It is also noted that the threaded holes in the respective heads are in linear alignment so that the threaded shaft easily threads with the respective heads, such as shown in FIG. 23 or, in the last embodiment in FIGS. 16 and 17.

Figure 17:
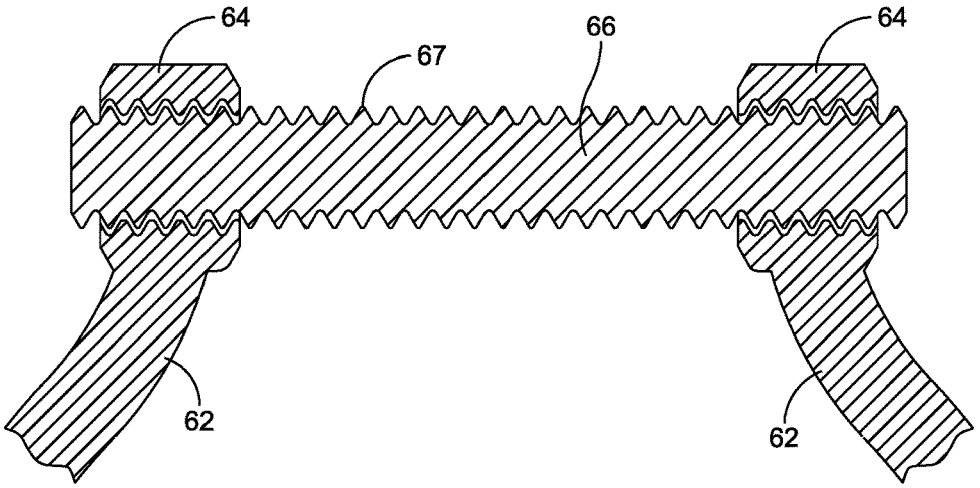
FIG. 17 is a cross-sectional view taken along line 17-17 of FIG. 16.

A last embodiment of the present invention is illustrated in FIGS. 16-20. This also is in the form of a bracelet 60 having a main loop 62 and respective end heads 64. Each of the end heads has an internal threaded passageway for receiving the threaded shaft 66. FIG. 17 is a cross-sectional view showing the threaded shaft 66 with its external threads 67 engaged with internal threads in the passageway of the respective heads 64.

Figure 18:
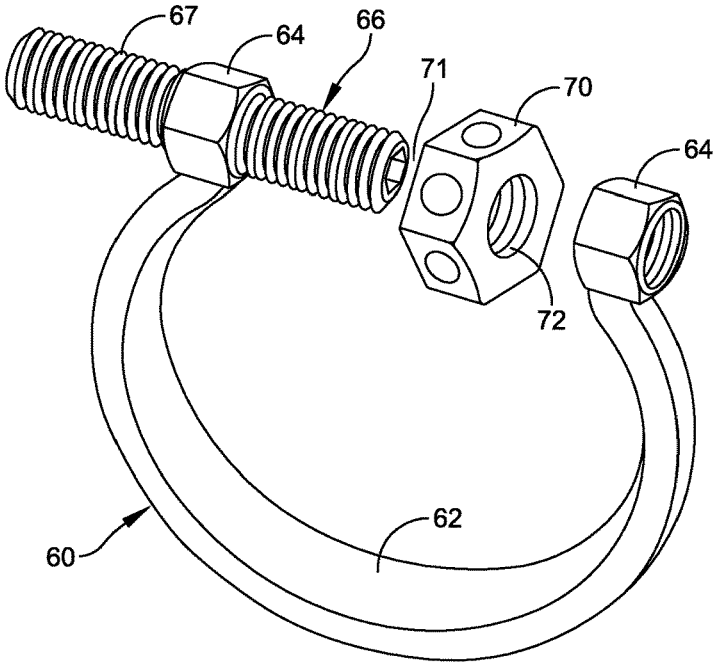
FIG. 18 is a perspective view similar to that shown in FIG. 16 showing the threaded shaft being threaded away from one of the head members to receive a decorative nut.
Figure 19:
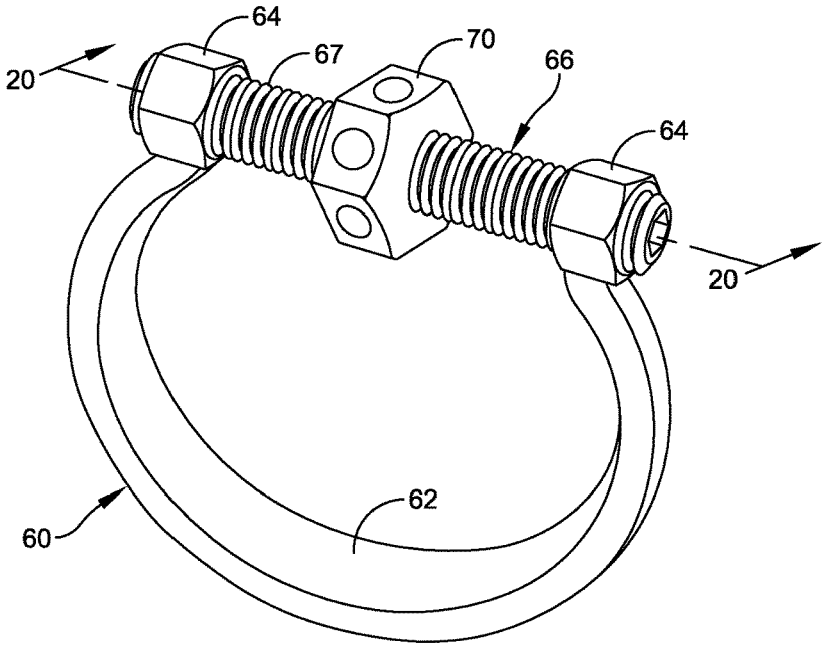
FIG. 19 is a perspective view similar to that illustrated in FIG. 18 showing the threaded shaft engaged with both heads.
Figure 20:
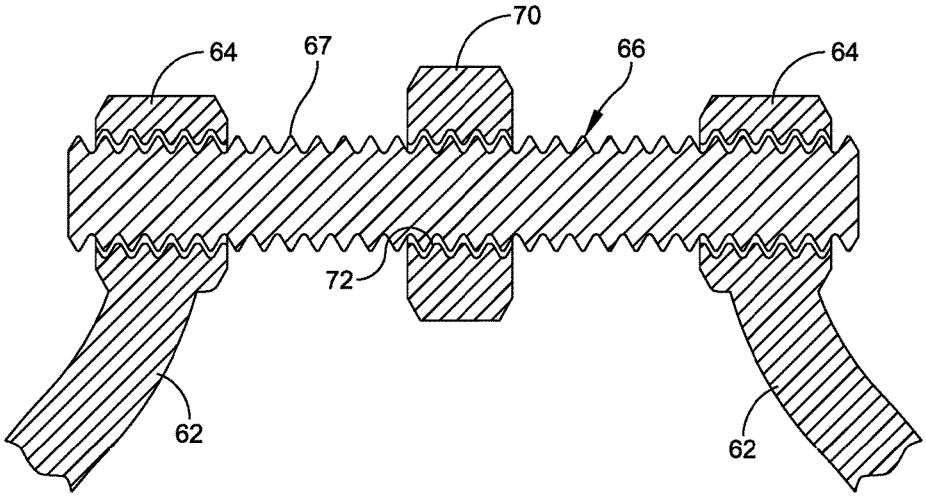
FIG. 20 is a cross-sectional view taken alone line 20-20 of FIG. 19.

FIGS. 18-20 also illustrate the threaded shaft 66 being threaded away from one of the heads 64 so as to provide a gap at 71. The nut 70 with its internal threads 72 can then be threaded onto the threads 67 of the threaded shaft 66. Although one nut 70 is shown in the drawings, multiple nuts and other decorative items can also be threaded onto the shaft 66. After a nut 70, or multiple nuts, has been threaded onto the shaft 60 then the shaft 60 may also be threaded with the head 64 on the right side in FIG. 19.

As indicated previously, these various nut configurations can be swapped between the various embodiments as long as the threading pattern is the same. Also, the threaded shafts are to a certain extent interchangeable between the various embodiments that are described. Regarding the decorative nut configurations, these can also be used with a ring structure such as shown in a co-pending application Serial No. 62/243,278 filed on even date herewith. Such a decorative nut construction can be used as the top mounting member in this co-pending application.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A jewelry product that is to be worn by a user and that is comprised of:

a main shaft that includes a threaded shaft portion integral with a head portion;

a hanging link for support of the main shaft from a body part;

a plurality of decorative nuts for threaded engagement with the threaded shaft portion;

wherein the head portion is supported by the hanging link;

wherein the threaded shaft portion has a length that is longer than a length of the head portion;

wherein the hanging link is comprised of a series of individual closed loops that engage each other to form a serial hanging link;

wherein the head portion is solid in construction and is comprised of multiple contiguous sides;

wherein the multiple contiguous sides of the head portion includes opposed flat wall surfaces that are disposed in parallel with each other;

wherein the head portion further has a through hole that extends between the opposed flat wall surfaces of the head portion;

wherein the head portion has a joined end integral with the threaded shaft portion and a free end;

wherein the through hole in the head portion is disposed closer to the free end of the head portion than the joined end;

wherein the through hole in the head portion is of a diameter slightly larger than a width of each closed loop; and wherein the hanging link passes through the through hole in the head portion in order to support the jewelry product from the body part.

2. The jewelry product of claim 1 wherein the head portion is of a polygon shape.

3. The jewelry product of claim 2 wherein the head portion is of a hexagonal shape.

4. The jewelry product of claim 3 wherein the hexagonal shape forms the opposed flat wall surfaces.

5. The jewelry product of claim 1 wherein the plurality of decorative nuts includes adjacent decorative nuts.

6. The jewelry product of claim 5 wherein the adjacent decorative nuts are maintained in contact with each other on the threaded shaft portion.

7. The jewelry product of claim 6 wherein the adjacent decorative nuts are each hexagonal in shape having opposed flat surfaces.

8. The jewelry product of claim 7 wherein the opposed flat surfaces of the adjacent decorative nuts are disposed in parallel with each other.

9. The jewelry product of claim 8 wherein the adjacent decorative nuts have different widths.

10. The jewelry product of claim 1 wherein the opposed flat wall surfaces are of substantially equal rectangular area, each having a length measured in a longitudinal direction of the main shaft, and each having a width measured transverse to the length that is less than the length of the flat wall surface.

11. The jewelry product of claim 10 wherein, when the hanging link is disposed within the through hole, the hanging link has multiple and serially arranged individual closed loops disposed within the through hole.

12. The jewelry product of claim 11 wherein the through hole in the head portion has a through hole length measured between the opposed flat wall surfaces, and wherein when the hanging link is disposed within the through hole, the hanging link extends across the entire through hole length.

13. A jewelry product that is to be worn by a user and that is comprised of:

a main shaft that includes a threaded shaft portion integral with a head portion;

a hanging link for support of the main shaft from a body part;

a plurality of decorative nuts for threaded engagement with the threaded shaft portion;

wherein the head portion is supported by the hanging link;

wherein the threaded shaft portion has a length that is longer than a length of the head portion;

wherein the hanging link is comprised of a series of individual closed loops that engage each other to form a serial hanging link;

wherein the head portion is solid in construction and is comprised of multiple contiguous sides;

wherein the multiple contiguous sides of the head portion includes opposed flat wall surfaces that are disposed in parallel with each other;

wherein the head portion further has a through hole that extends between the opposed flat wall surfaces of the head portion;

wherein the through hole in the head portion is of a diameter slightly larger than a width of each closed loop;

wherein the hanging link passes through the through hole in the head portion in order to support the jewelry product from the body part;

wherein the multiple contiguous sides of the head portion includes at least two sets of opposed flat wall surfaces;

wherein the plurality of decorative nuts includes adjacently disposed decorative nuts that are maintained in contact with each other on the threaded shaft portion;

wherein the adjacent decorative nuts have different widths;

wherein the head portion has a joined end integral with the threaded shaft portion and a free end;

wherein the through hole in the head portion is disposed closer to the free end of the head portion than the joined end;

wherein, when the hanging link is disposed within the through hole, the hanging link has multiple and serially arranged individual closed loops disposed within the through hole;

wherein the through hole in the head portion has a through hole length measured between the opposed flat wall surfaces; and wherein, when the hanging link is disposed within the through hole, the hanging link extends across the entire through hole length.

14. The jewelry product of claim 13 wherein the head portion is of a hexagonal shape.

15. The jewelry product of claim 14 wherein the adjacent decorative nuts are each hexagonal in shape having opposed flat surfaces.

16. The jewelry product of claim 15 wherein the opposed flat surfaces of the adjacent decorative nuts are disposed in parallel with each other.

17. The jewelry product of claim 13 wherein the opposed flat wall surfaces are of substantially equal area, each having a length measured in a longitudinal direction of the main shaft, and each having a width measured transverse to the length that is less than the length of the flat wall surface.

18. A jewelry product that is to be worn by a user and that is comprised of:

a main shaft that includes a threaded shaft portion integral with a head portion;

a hanging link for support of the main shaft from a body part;

a plurality of decorative nuts for threaded engagement with the threaded shaft portion;

wherein the head portion is supported by the hanging link;

wherein the threaded shaft portion has a length that is longer than a length of the head portion;

wherein the hanging link is comprised of a series of individual closed loops that engage each other to form a serial hanging link;

wherein the head portion is solid in construction and is comprised of multiple contiguous sides;

wherein the multiple contiguous sides of the head portion includes opposed flat wall surfaces that are disposed in parallel with each other;

wherein the opposed flat wall surfaces are of substantially equal rectangular area, each having a length measured in a longitudinal direction of the main shaft, and each having a width measured transverse to the length that is less than the length of the flat wall surface;

wherein the head portion further has a through hole that extends between the opposed flat wall surfaces of the head portion;

wherein the through hole in the head portion is of a diameter slightly larger than a width of each closed loop; and wherein the hanging link passes through the through hole in the head portion in order to support the jewelry product from the body part.

* * * * *